United States Patent [19]

Shoop et al.

[11] 4,147,475

[45] Apr. 3, 1979

[54] CONTROL SYSTEM FOR HELICAL SCREW COMPRESSOR

[75] Inventors: John C. Shoop; Roger L. Post; Michael G. Herschler, all of Quincy, Ill.

[73] Assignee: Gardner-Denver Company, Dallas, Tex.

[21] Appl. No.: 830,558

[22] Filed: Sep. 6, 1977

Related U.S. Application Data

[62] Division of Ser. No. 685,229, May 11, 1976, Pat. No. 4,052,135.

[51] Int. Cl.[2] ..... F04B 49/02; F04B 49/08

[52] U.S. Cl. ..... 417/310; 418/100; 418/201

[58] Field of Search ..... 417/307, 308, 310, 311; 418/201, 202, 203, 84, 100; 415/27

[56] References Cited

U.S. PATENT DOCUMENTS

| | | | |
|---|---|---|---|
| 3,205,823 | 9/1965 | Brown | 417/310 |
| 3,432,089 | 3/1969 | Schibbye | 417/310 |
| 3,737,252 | 6/1973 | Pilarczyk et al. | 417/307 |
| 3,874,828 | 4/1975 | Herschler et al. | 418/201 |
| 4,063,855 | 12/1977 | Paul | 418/84 |

FOREIGN PATENT DOCUMENTS

| | | | |
|---|---|---|---|
| 1335024 | 10/1973 | United Kingdom | 418/201 |

*Primary Examiner*—Carlton R. Croyle
*Assistant Examiner*—Thomas J. Ross
*Attorney, Agent, or Firm*—Michael E. Martin

[57] ABSTRACT

A helical screw air compressor unit has a rotary capacity control valve, a compressor inlet throttling valve, and a pressure relief valve for venting the compressor discharge conduit. A control circuit senses pressure in the compressed air supply system downstream of the compressor and operates the capacity control valve, inlet throttling valve, and pressure relief valve in a predetermined sequence to provide an improved power consumption characteristic for variable demand compressor applications. The control circuit includes a hydraulic control valve and an actuator for operating the rotary capacity control valve to regulate compressor throughput to maintain a predetermined pressure without overpressuring the supply during operation at conditions of reduced demand for compressed air.

4 Claims, 5 Drawing Figures

CONTROL SYSTEM FOR HELICAL SCREW COMPRESSOR

This is a division of application Ser. No. 685,229, filed May 11, 1976, now U.S. Pat. No. 4,052,135.

BACKGROUND OF THE INVENTION

The application of helical screw compressors for supplying compressed air to operate pneumatic construction equipment and for industrial plant compressed air networks and process systems usually requires that the compressor be equipped with some form of compressor throughput or capacity control. Conventional control systems for helical screw air compressors are characterized by controls which operate to throttle the compressor inlet or vent the compressor discharge line during periods of reduced demand. Control systems are known which combine the aforementioned types of controls and which may also include start-stop controls for certain types of motor driven compressors. An example of a compressor control system which combines inlet throttling, discharge line venting, and start-stop control is disclosed in U.S. Pat. No. 3,860,363.

Although helical screw compressors control systems which operate with one or more of the aforementioned types of control may be capable of regulating the supply of compressed gas in accordance with demand, they are relatively inefficient and, in particular, may not be desirable for use with relatively large compressors. Helical screw compressor units which operate with inlet throttling control require considerable power to drive the compressor even when the compressor inlet is throttled to zero compressor gas throughput. Controls which operate to vent the compressor discharge line, and liquid reservoir in the case of liquid injected compressors, may provide for power consumption characteristic which is not much better than inlet throttling control. Power savings for compressor units which operate to vent the compressor discharge line with or without combined inlet throttling are subject to the network storage capacity and the compressed air demand characteristic. Moreover, the start-stop type controls may not be suitable for large electric motor driven compressors.

Helical screw compressors have been modified to include portions of the compressor casing wall which are movable to provide for capacity control by altering the closing of the variable volume chambers formed by the intermeshing rotors. Such devices include axial sliding members such as disclosed in U.S. Pat. No. 3,432,089. The axial slide valve capacity control device is relatively expensive to manufacture and assemble and increases the capital cost of compressor units so equipped. For industrial air and gas compressor units it has been determined that a known type of rotary capacity control valve is less expensive to manufacture and for many compressor applications provides suitable control characteristics for saving compressor input power in accordance with the variations in the demand for compressed air which are normally encountered.

SUMMARY OF THE INVENTION

The present invention is characterized by a helical screw compressor unit having a control system for regulating compressor gas throughput wherein an improved power consumption characteristic may be realized when the compressor is operating at less than full capacity.

The compressor control system in accordance with the present invention includes a combination of control elements which are operated in a predetermined sequence whereby improved part load efficiency may be realized for helical screw air and gas compressor units in particular.

In accordance with the present invention a helical screw air compressor is provided with a capacity control valve and a compressor inlet throttling valve which are controlled to operate in a predetermined sequence whereby the power consumed by the compressor, when operating at part load or less than full capacity, is reduced below that obtainable with control systems which comprise inlet throttling alone. Moreover, for many applications, including industrial plant air supply, the compressor system of the present invention provides for more efficient operation than is obtainable with systems which combine inlet throttling with means for venting the compressor discharge line.

The compressor control system of the present invention further provides a capacity control valve and associated actuating mechanism which is operable to control the throughput capacity of a helical screw compressor without overpressuring the compressed air supply system during reduced capacity operation of the compressor. Accordingly, the capacity control valve may be operated to maintain a predetermined system pressure within the capacity range of the control valve thereby a considerable savings in power may be realized particularly for prolonged operation of the compressor at reduced capacity.

The combination of a helical screw air compressor and associated controls according to the present invention provides a compressor system which is uncomplicated and is more economical to manufacture than known prior art systems which are characterized by axial slide capacity control valves. Moreover, power savings are greater with the compressor system of the present invention than what can be realized with most other types of capacity control systems for helical screw compressors.

DESCRIPTION OF THE PREFERRED EMBODIMENT

Figure 1:
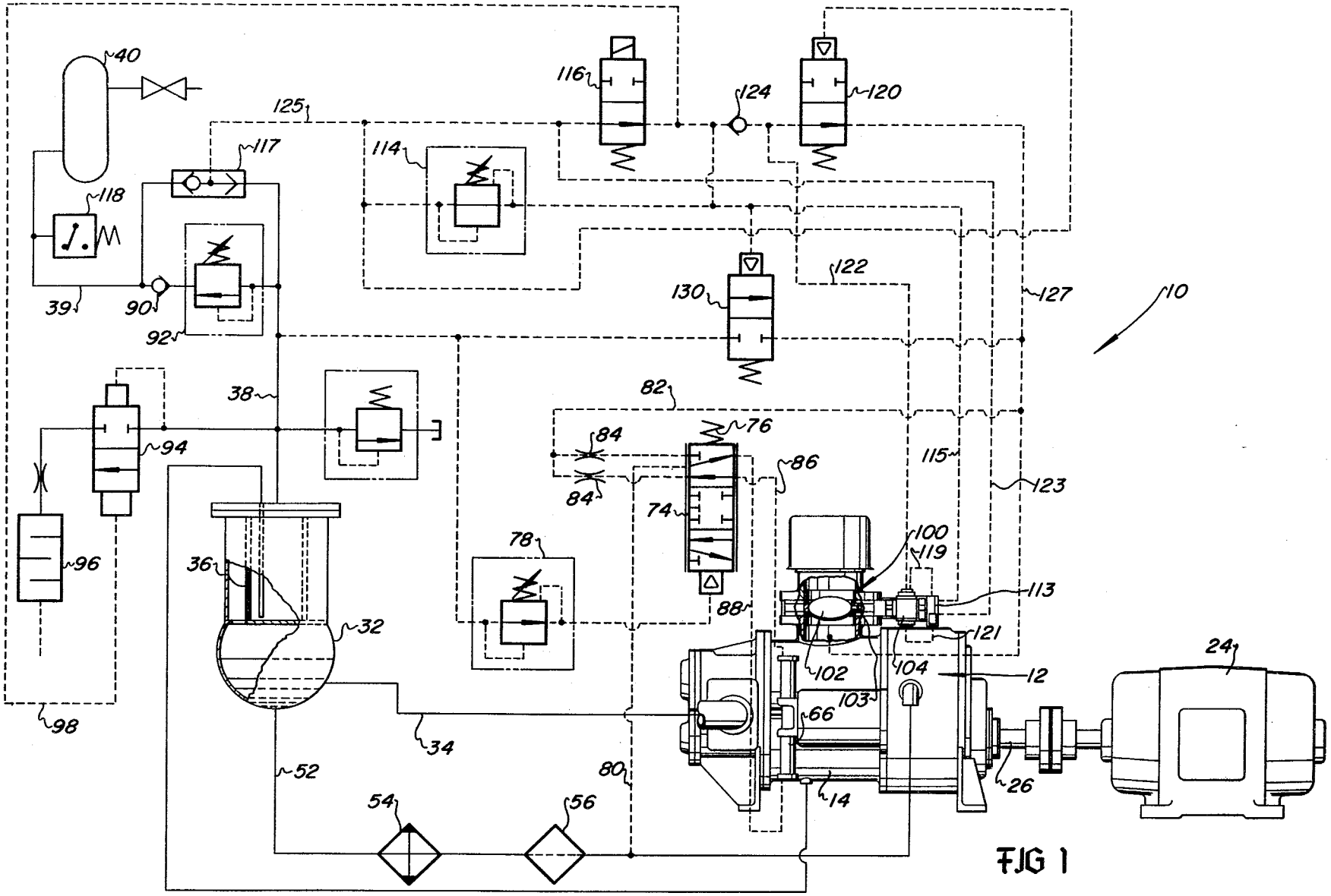
FIG. 1 is a schematic diagram of a helical screw gas compressor and control system according to the present invention.

Referring to FIG. 1 a liquid injected helical screw gas compressor and control system is illustrated in schematic form and generally designated by the numeral 10. The compressor system includes a helical screw air compressor 12, shown also in FIGS. 2 and 3, which is characterized by a casing 14 having a pair of parallel intersecting bores 16 and 18. The compressor 12 includes a pair of intermeshing screw rotors 20 and 22 rotatably disposed in the respective bores 16 and 18. The rotors 20 and 22 are cooperable with the casing 14 to form plural variable volume chambers 11 and 23 for displacing gas entrapped therein. A motor 24 is drivably connected to one or the other of the rotors by a suitable shaft portion 26 and drive gearing 27. The compressor 12 is provided with an inlet port 28 and a discharge port 30. The discharge port 30 is in communication with a liquid separator and reservoir tank 32 by way of a conduit 34. The tank 32 includes a suitable liquid separator element 36 for separating liquid from the compressed gas passing through the tank 32 to a discharge line 38. The line 38 is in communication with a compressed air service line 39 leading to a storage vessel represented by the tank 40. The line 39 may also be connected directly to a plant air piping network or process system depending on the compressed air storage capacity of the piping network or system.

The compressor 12 is further characterized by a cylindrical bore 42 in the casing 14 in which is disposed a rotary capacity control valve 44. The valve is formed as a cylindrical member which is closely fitted in the bore 42 and is formed to have a helical control edge 46. The valve 44 is operable when rotated to progressively uncover a series of auxiliary ports 50 which open through the wall of the casing 14 into the bore 42 from the bores 16 and 18. In accordance with the rotative position of the control valve 44 the compressor throughput capacity may be varied from the full swept volume capacity of the rotors 20 and 22, not considering leakage losses, to approximately 40 percent of full capacity by reducing the effective displacement volume of the chambers formed by the intermeshing rotors. A more detailed description of a helical screw compressor equipped with a rotary capacity control valve generally similar to the compressor 12 is disclosed in U.S. Pat. No. 3,874,828. The maximum range of capacity control regulation of a compressor equipped with a rotary valve of the general type described herein may be predetermined to be greater than 40 percent of full capacity. However, locating auxiliary bypass ports near the high pressure or discharge end of a helical screw compressor designed for a built-in volume ratio of approximately 4:1 results in a decrease in compressor efficiency when the compressor is operated at a reduced capacity which is less than approximately forty percent of full capacity.

The compressor 12 is adapted to inject liquid into the bores 16 and 18 for mixing with the gas being compressed. The liquid injection system may be generally in accordance with the system described in U.S. Pat. No. 3,874,828. Liquid is separated from the gas being compressed and is stored in the tank 32 and continuously recirculated to the compressor by way of a conduit 52 and a suitable heat exchanger 54 and filter 56. The liquid normally used is a petroleum base oil comparable to the conventional automotive engine and automatic transmission lubricants. Liquid is recirculated by the pressure differential between the reservoir tank 32 and the injection passages in the valve member 44 which is normally sufficient to provide for adequate liquid flow under all compressor operating conditions. Some compressor systems may use a pump interposed in the conduit 52, however.

Figure 2:
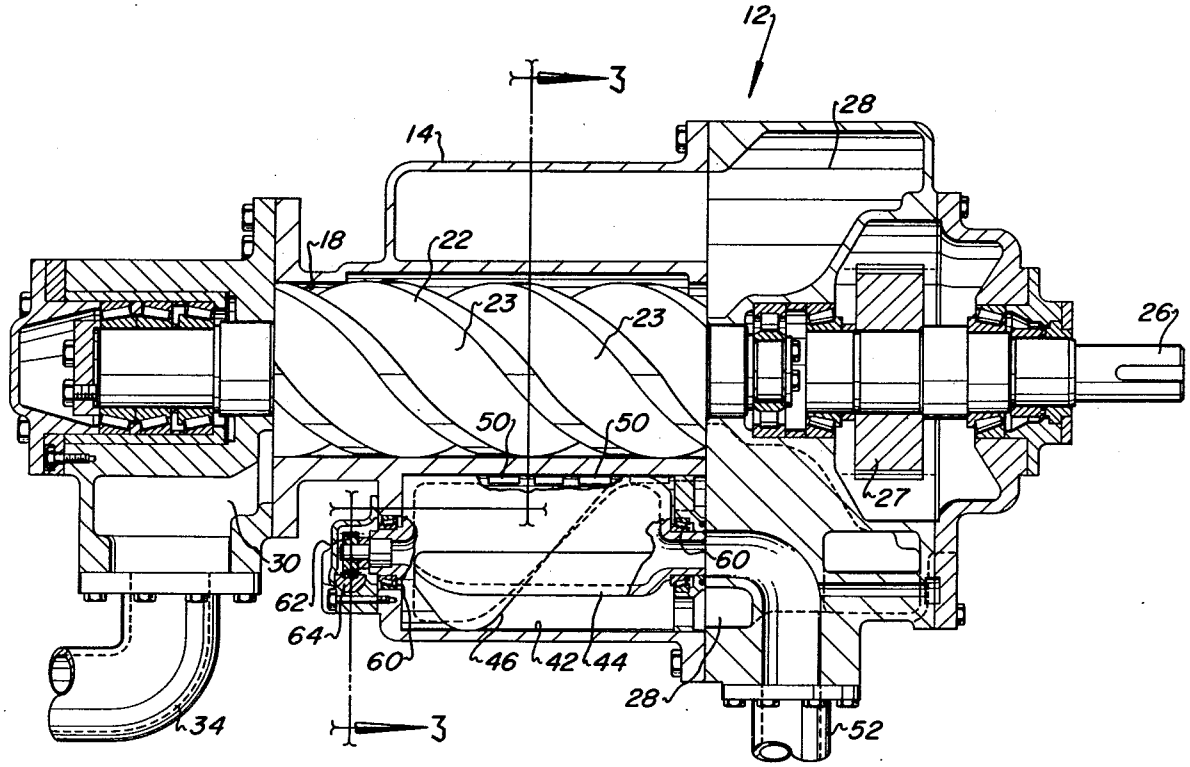
FIG. 2 is a longitudinal section view of the compressor of the system of FIG. 1.
Figure 3:
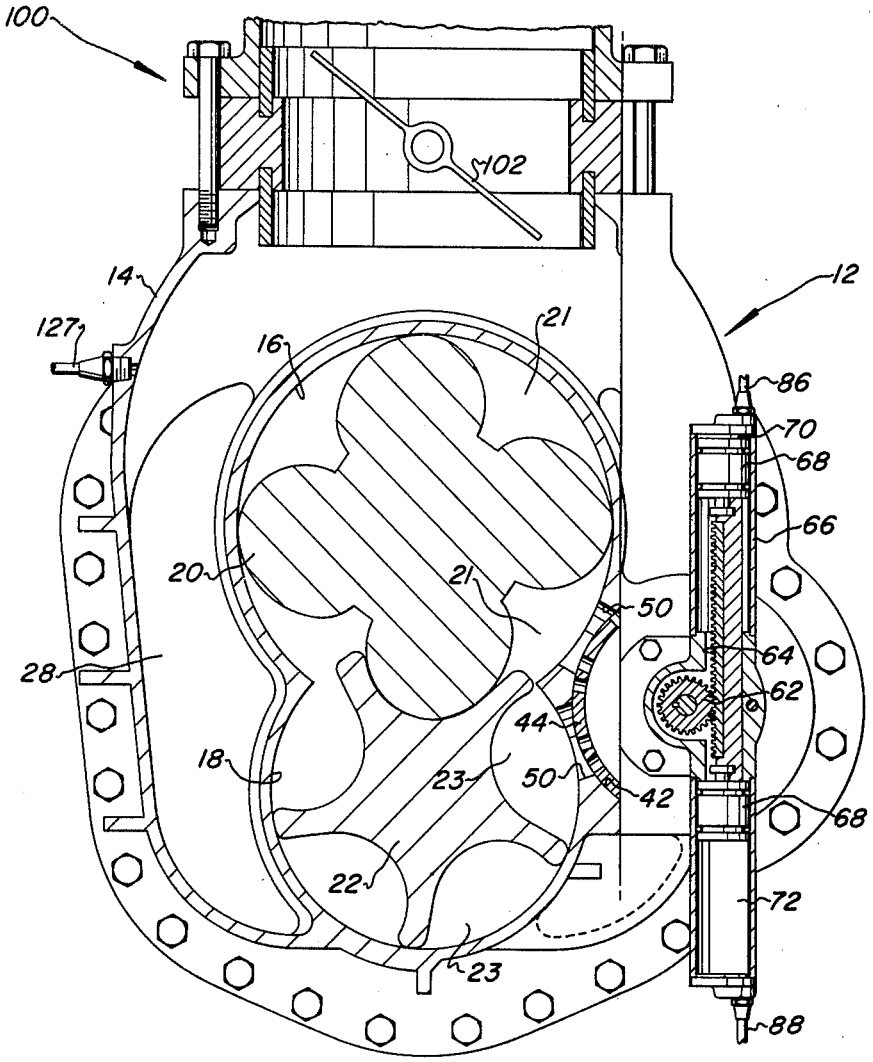
FIG. 3 is a section view taken along the line 3—3 of FIG. 2.

Referring to FIGS. 2 and 3 the control valve 44 is mounted in suitable bearings 60 and includes a shaft portion having a gear 62 fixed thereon. The gear 62 is meshed with a gear rack 64 which comprises part of an actuator 66 for the valve 44. The rack 64 is connected at its opposite ends to opposed pistons 68 disposed in chambers 70 and 72 formed in cylinder portions of the actuator 66. Pressure fluid from the control system of FIG. 1 may be introduced into the chamber 70 or chamber 72 to act on the pistons to rotate the valve 44 in opposite directions.

Referring to FIG. 1 the actuator 66 is adapted to be controlled for positioning the valve member 44 by a control valve 74. The valve 74 is characterized as a four-way valve which is pressure fluid operated to move in one direction. A spring 76 is operable to bias the valve 74 in the direction opposite to that caused by pilot pressure fluid. The valve 74 is operable to control the flow of liquid to the actuator for positioning the rotary control valve 44 in accordance with the pressure sensed in the compressed air supply system. In the compressor system 10 pressure is sensed in the line 38 by a pressure control valve 78 which is also connected to the pilot actuator of the valve 74. The pressure control valve 78 is operable to provide a pressure signal to the pilot actuator of the valve 74 when the pressure in line 38 exceeds a predetermined amount. As shown in the diagram of FIG. 1 pressure liquid is supplied to the valve 74 from the conduit 52 by way of a conduit 80. An exhaust or drain conduit 82 is connected to the valve 74 and leads to the compressor inlet port 28 for draining liquid from the actuator. Orifices 84 are provided to adjust the operating characteristics of the valve 74 and actuator 66 to prevent the rotary control valve from instability in its control of compressor gas throughput. The valve 74 is connected to the opposed chambers of the actuator 66 by conduits 86 and 88.

The compressor system 10 includes further control elements which are in communication with the compressed air discharge and service line 38–39 downstream of the reservoir tank 32. As shown in FIG. 1 a check valve 90 and a minimum pressure valve 92 are interposed in the line 38–39. For purposes of this description the service line 39 will be considered that portion of the compressed gas conduit downstream of the check valve 90. The minimum pressure valve 92 provides for a sufficient pressure in the tank 32 during normal part load or full load operation of the compressor to prevent liquid entrainment in the gas leaving the tank. For the compressor system 10 the valve 92 may be adapted to maintain a minimum gage pressure in the tank 32 in the range of 413 to 482 kPa when the compressor 12 is operating to compress air from an ambient atmospheric inlet pressure condition. A pilot pressure fluid operated blowdown valve 94 is in communication with the line 38 and is operable, on being supplied with a pressure fluid signal, to blowdown or vent the line 38 and the tank 32 to atmosphere by way of a suitable muffler 96 whereby the back pressure on the compressor may be reduced. The valve 94 is pilot operated to both positions and will move to the closed position only when pressure in line 38 is greater than the pressure in the pilot signal conduit 98 by a predetermined amount.

Figure 4:
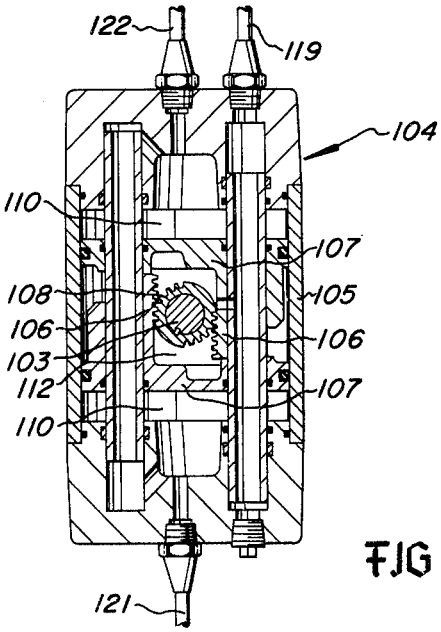
FIG. 4 is a section view of an actuator for the compressor inlet throttling valve; and, FIG. 5 is a diagram illustrating the relative efficiency of various compressor control systems when the compressor is operating at less than full capacity.

The compressor 12 is provided with an inlet throttling valve generally designated by the numeral 100. The throttling valve 100 is characterized by a rotating disk or butterfly type closure member 102 mounted on a rotatable stem 103 and adapted to be positioned to provide controlled throttling of the gas (air) flowing into the compressor 12. The valve 100 is adapted to be operated by a double acting or reversible actuator 102 shown in section in FIG. 4. The actuator 104 is of a type known in the art of pneumatic actuators and may be, in particular, a model known as a Flowmate 38 double rack and pinion actuator commercially available from Worcester Controls Corp., West Boylston, Massachusetts U.S.A. The actuator 104 includes a housing 105 in which two opposed pistons 107 are formed to have axially projecting gear racks 106 which in turn are meshed with a gear 108 drivably connected to the stem 103 of the valve disk 102. Accordingly, pressure fluid admitted to chambers 110 and 112 of the actuator 104 provide for rotation of the valve disk to regulate the flow of inlet air to the compressor 12.

The throttling valve 100 is also provided with a control device 113 which provides pressure fluid to the actuator 104 to position the valve disk in accordance with a pressure fluid signal received by way of a conduit 115. The device 113 is of a known commercial type which is also commercially available from Worcester Controls Corporation. The particular device used on the disclosed embodiment of the present invention is known as a Flomate Series 15 Variflow Positioner. The control device 113 is adapted to receive a pressure air supply by way of a conduit 123. The conduit 123 is connected to a conduit 125 which is connected to the discharge service line 38–39 by way of a shuttle valve 117 whereby the higher pressure prevailing either upstream or downstream of the check valve 90 and minimum pressure valve 92 is sensed. A pressure control valve 114 is interposed in the conduit 115 and is operable to supply pressure air at a reduced pressure which varies in relation to the pressure in the conduit 125 and the service line 38–39. Pressure air is supplied from the control device 113 to the actuator 104 by conduits 119 and 121. The valve 100 may thereby be controlled by the control device 113 and actuator 104 to throttle inlet gas flow to the compressor 12 in accordance with the pressure in the line 38–39.

The control system shown in FIG. 1 further includes a solenoid operated valve 116 which is operably connected to a pressure switch 118. The pressure switch 118 senses the pressure in the line 39 downstream of the check valve 90. The valve 116 is operable to be open when deenergized and accordingly the switch 118 opens on increasing pressure in the line 39 to cause the valve 116 to move to the open position. The valve 116 may also be suitably interconnected with the electrical circuit which energizes the motor 24 and in such a way that when the motor is deenergized the valve 116 opens also. As shown in FIG. 1 the valve 116 is connected to supply pressure air to one of the pilot actuators of valve 94 as well as to the signal pressure conduit 115 of the control device 113 and to the actuator 104 directly. The valve 116 is operable, on being opened as a result of increasing pressure in the line 39, to cause valve 94 to open. The valve 116, on opening, also supplies pressure air at service line pressure directly to the actuator 104 by way of a conduit 122 to cause the throttling valve 100 to be closed tightly to substantially throttle the flow of inlet air to the compressor 12. Accordingly, at a predetermined pressure sensed by the switch 118 the compressor 12 is caused to operate in an idling mode with no compressed air supplied to the line 39 and with the pressure substantially reduced in the line 38, the tank 32, and the discharge conduit 34. In this mode the power consumption at a given compressor speed may be on the order of 20 to 25 percent of full capacity power consumption depending on such factors as compressor size and liquid injection rate.

The control system of FIG. 1 further includes a valve 120 which is normally open and is closed by a pilot pressure fluid signal from the service line 38–39. The valve 120 is in communication with a conduit 127 which is connected to the compressor inlet port. The valve 120 is also in communication with the valve actuator 104 by way of the conduit 122 and with the signal pressure conduit 115 by way of a check valve 124. The throttling valve 100 is normally, at compressor startup or reloading, in the closed condition. Accordingly, a negative pressure or vacuum condition in the inlet port 28 of the compressor may be used to cause the actuator 104 to open the throttling valve 100 if the pressure in the conduit 125 is less than a predetermined minimum. As soon as the pressure in conduit 125 increases to a value somewhat below the minimum pressure which will provide a signal pressure from the pressure control valve 114 the valve 120 is closed so that the throttling valve 100 is responsive to a pressure signal from the control valve 114 and control device 113 or a pressure signal from the conduit 122 by way of the valve 116.

The control system of FIG. 1 also is characterized by a two-position valve 130 which is operable to supply a controlled rate of inlet air flow to the compressor 12 when the throttling valve 100 is closed tight. The valve 130 is responsive to a pressure signal from the pressure control valve 114 to move to the open position. Air is recirculated from the tank 32 to the compressor to prevent pressure buildup in the system if the tank has not been depressurized by opening of the valve 94. Liquid injected helical screw compressors normally require a small throughput of working fluid when running at idle to reduce vibration and noise. The amount of gas circulated through the compressor has negligible effect on the total power consumption of the compressor.

Figure 5:
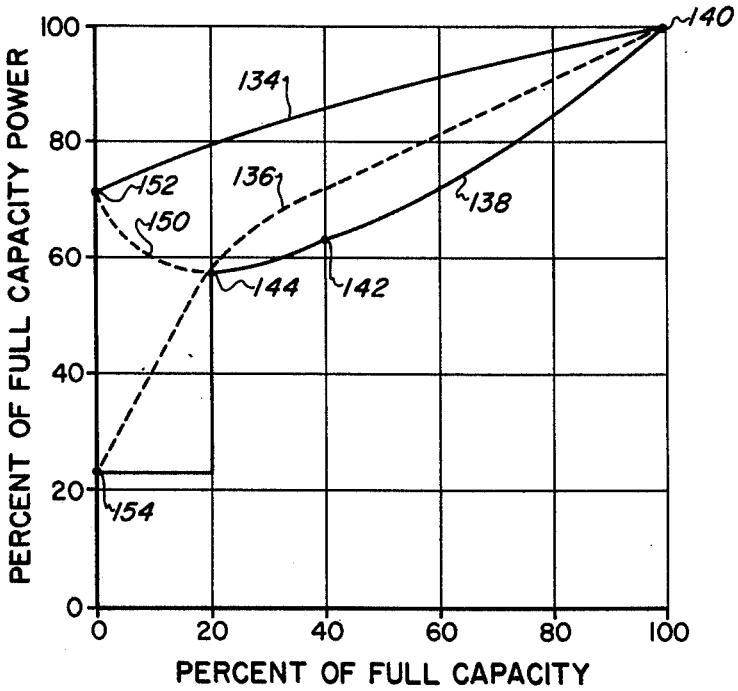

The compressor system of the present invention provides for reduced compressor power consumption when operating at less than full capacity of compressed air throughput. FIG. 5 is a graph which shows the power requirements of a helical screw air compressor system generally of the type described herein at various capacities as compared with prior art compressor control systems. In FIG. 5 the horizontal scale represents compressor capacity from zero throughput to 100 percent capacity. The vertical scale represents power consumption as a percent of full compressor capacity power consumption.

In FIG. 5 the line 134 illustrates the characteristic of a compressor system which operates by merely throttling the compressor inlet gas flow from 100 percent capacity down to zero throughput. The power consumption varies substantially linearly and decreases down to about 70 percent of full power at zero gas delivery. This characteristic is typical of liquid injected helical screw air compressors which are designed to operate at relatively high gas discharge gage pressures of approximately 689 kPa.

The line 136 in FIG. 5 illustrates the power consumption characteristic of a compressor system which combines inlet throttling with venting of the compressor discharge line. The characteristic represented by the line 136 may require more power up to the throttled inlet characteristic represented by line 134 or a somewhat steeper slope may be experienced depending on the capacity of the plant piping network or process system and the demand cycle of compressed gas usage. The line 136 is understood to be an average characteristic and takes into account the power consumed during the venting phase of compressor unloading and the power consumed during compressor operation to repressurize the discharge conduit and liquid reservoir tank.

The compressor system disclosed herein provides an improved combination of elements and control function which is represented by the line 188. As may be noted from viewing FIG. 5 compressor gas throughput is controlled from point 140, which is 100 percent of capacity, to point 142 which is approximately 40 percent of full capacity by operation of the control valve 44 to decrease the effective swept volume of the intermeshing rotors. From point 142 to point 144, the latter representing about 20 percent of full capacity, the compressor throughput may be controlled by progressive closure of the throttling valve 100. The compressor system 10 may be adapted to be regulated from 20 percent of full capacity to zero output by throttling the compressor inlet but as may be noted by the dashed line 150 to the power consumption at less than 20 percent of compressor throughput capacity increases with decreasing compressor capacity to point 152 which is the power consumption for a compressor with only inlet throttling regulation of compressed gas throughput.

In accordance with the compressor system 10 if the compressor is throttled down to approximately 20 percent of capacity a further increase in service line pressure will actuate the pressure switch 118 to open thereby deenergizing the valve 116 and causing that valve to open as well as causing valve 94 to open venting the compressor discharge conduit 34 and the reservoir tank 32. Actuation of the valve 116 will provide pressure air at full service line pressure to the actuator 104 causing the inlet throttling valve 100 to be closed completely reducing the compressor gas flow throughput to a negligible amount. Accordingly, the compressor power consumption will be reduced to the rate indicated by point 154 on the graph of FIG. 5 and the compressor will run at idling power until system pressure drops sufficiently to close switch 118. The switch 118 is desirably of the differential pressure type which will not reclose until the pressure in line 39 has decreased a predetermined amount.

The compressor system 10 also provides for reduced power consumption when operating between full capacity and the maximum reduction in capacity which may be obtained by actuation of the rotary control valve 44. Thanks to the combination of the valves 74 and 78 and the turn valve actuator 66 the control valve 44 may be moved to any position between full capacity and the maximum reduced capacity position without any sustained increase in system pressure. Accordingly, no power is wasted by overpressuring the system above the desired working pressure.

By way of example, if the pressure condition in the line 38–39 is to be maintained at a gage pressure of 689 kPa, the pressure control valve 78 is set to provide a signal pressure at that condition which will oppose the force of the spring actuator 76 of valve 74 and hold the valve in the position which will block the flow of fluid to both of the chambers 70 and 72 of the actuator. However, only a small increase in pressure in the line 38 or the line 39, on the order of 7 kPa, will produce an equal increase in the control pressure provided by the valve 78 which is sufficient to move the valve 74 to the position which will place conduit 80 in communication with conduit 86 and provide pressure fluid to chamber 70 to rotate the valve 44 to further reduce the gas throughput of the compressor 12. When the compressor capacity has been reduced to cause the service line pressure to return to 689 kPa the valve 74 will be moved to the blocked condition to hold the control valve 44 at the new position. If the pressure in line 39 decreases below a gage pressure of 689 kPa the signal pressure developed by valve 78 will decrease and the valve 74 will shift to the position providing pressure fluid to the chamber 72 of the actuator and causing the valve 44 to rotate to an increased capacity position.

If the pressure in the service line 39 tends to increase after the compressor capacity has been reduced as much as possible by the rotary valve 44 the pressure control valve 114 will, at a pressure above the actuating pressure for the valve 78, begin to provide a signal pressure to the inlet throttling valve control device 113. For example, the valve 114 may be set to provide a 7 kPa signal pressure to the control device 113 when the service line pressure reaches approximately 703 kPa gage pressure. For every 7 kPa increase in pressure above 703 kPa a 7 kPa increase in signal pressure will be provided by the valve 114 to the control device 113 causing a progressive closing action on the inlet throttling valve.

The pressure switch 118 may be set to open when the service line pressure reaches a value commensurate with compressor gas throughput of approximately 20 percent of compressor capacity. When the switch 118 opens on increasing pressure valves 116 and 94 will move to their open positions causing the reservoir tank 32 to be vented and the throttling valve 100 to close completely.

Valve 130 will be moved to the open position to allow a small recirculating flow of air through the compressor 12 which is now working from a near total vacuum condition in the compressor inlet port 28 to an atmospheric pressure condition in the discharge conduit 34. A decrease in pressure in line 38 will cause the valve 74 to shift to the position which will return the rotary control valve 44 to the full capacity position.

The switch 118 may be set to reclose at a service line pressure which is less than the control pressure at which the control valve 44 begins to reduce the throughput of the compressor. Typically, the pressure at which the pressure switch closes may be a gage pressure of approximately 644 kPa or any pressure which will satisfy system requirements without causing rapid cycling of the control system, particularly the phase wherein the reservoir tank 32 is vented.

When service line pressure decreases to a value which will close the switch 118 the valve 116 will be energized to close and the valve 120, responsive to the pressure decrease in line 125 will open to place the actuator 104 in communication with the compressor inlet port 28 whereby a vacuum condition in the inlet port will operate to open the inlet throttling valve 100. Conduit 98 and the actuators of valves 94 and 130 will also be vented to cause the valves to move to a closed condition. As the compressor 12 works to increase pressure in the discharge conduit 34, the control system will be conditioned to regulate compressor capacity in the above described sequence when the pressure in the line 38–39 increases sufficiently.

The control system of FIG. 1 may be adapted to use a valve arrangement similar to the valves 74 and 78 for controlling directly the position of the actuator 104. With such a modification to the control system inlet gas may be progressively throttled by the valve 100 when the pressure in the service line 39 tends to increase above a second predetermined pressure which is slightly greater than the predetermined pressure which is maintained by movement of the rotary valve 44. Accordingly, within the operating range of the throttling valve 100 to modulate the gas throughput of the compressor 12 the pressure condition in service line 39 as well as the tank 32 and discharge conduit 34 can be controlled to be a second predetermined maximum. The pressure switch 118 could, of course, remain operable to cause actuation of the valve 116 if the service line pressure increases to a predetermined value greater than the second pressure condition.

Moreover, those skilled in the art of helical screw compressors and controls therefor will appreciate that the control system of FIG. 1 may be adapted to a helical screw compressor equipped with an axial slide type of capacity control valve instead of the compressor 12 of the preferred embodiment disclosed in detail herein.

What is claimed is:

1. A helical screw compressor and control system comprising in combination:

a helical screw gas compressor operably connected to a service line for delivering compressed gas to said service line, said compressor being characterized by a casing having a pair of parallel intersecting bores, an inlet port, and a discharge port, a pair of intermeshing helical screw rotors disposed in said bores and forming variable volume chambers;

capacity control valve means movable to vary the effective displacement volume of said variable volume chambers to regulate the flow of compressed gas through said compressor;

a pressure fluid operated actuator connected to said capacity control valve means and including a pair of opposed fluid chambers and piston means disposed in said fluid chambers and responsive to pressure fluid in said fluid chambers for moving said capacity control valve means, said control system including:

a four-way valve including actuating means for moving said four-way valve between first and second positions;

pressure fluid supply and return conduits connected to said four-way valve;

conduits leading to each of said fluid chambers from said four-way valve; and, pressure sensing means responsive to the pressure condition in said service line for providing a first pressure signal to said actuating means corresponding to a predetermined maximum pressure in said service line for moving said control valve to said second position blocking the flow of pressure fluid to both fluid chambers of said actuator, and said actuating means is responsive to receiving a second pressure signal from said sensing means corresponding to a variation in the pressure in said service line from said predetermined maximum pressure for moving said control valve to said first position to conduct pressure fluid to one of said fluid chambers and from the other of said fluid chambers to effect movement of said capacity control valve means to regulate the flow of gas through said compressor to substantially maintain the pressure in said service line at said predetermined maximum pressure.

2. The invention set forth in claim 1 wherein:

said sensing means comprises a pressure control valve operable to provide said first pressure signal to said actuating means to hold said control valve in said second position when the pressure in said service line corresponds to said predetermined maximum pressure, and said pressure control valve is operable to vary the magnitude of said pressure signal in response to a change in the pressure in said service line to cause said control valve to move to said first position.

3. The invention set forth in claim 1 wherein:

said compressor includes a cylindrical chamber in said casing, auxiliary ports in said casing openeing from at least one of said bores to said chamber, said capacity control valve means comprises a rotary valve disposed in said chamber and operable to be rotated to open and close said auxiliary ports to regulate the flow of compressed gas through said compressor, and said actuator is operable to rotate said rotary valve in one direction or the other in response to pressure fluid being supplied to said actuator by said control valve when the pressure in said service line varies from said predetermined maximum pressure.

4. The invention set forth in claim 1 together with:

means for injecting liquid into said compressor for mixing with air being compressed by said compressor and including a liquid separator and reservoir tank for storing liquid discharged from said compressor, said supply conduit for said control valve comprises a conduit for conducting liquid from said tank to said control valve, and said return conduit comprises a conduit connected to said control valve and in communication with said inlet port for returning liquid from said actuator to said compressor.

* * * * *